US006379175B1

(12) United States Patent
Reede

(10) Patent No.: US 6,379,175 B1
(45) Date of Patent: Apr. 30, 2002

(54) FIXTURE FOR CONTROLLING THE TRAJECTORY OF WIRES TO REDUCE CROSSTALK

(75) Inventor: Ivan Reede, Dollard des Ormeaux (CA)

(73) Assignee: Nordx/CDT. Inc., Quebec (CA)

( * ) Notice: Subject to any disclaimer, the term of this patent is extended or adjusted under 35 U.S.C. 154(b) by 0 days.

(21) Appl. No.: 09/275,988

(22) Filed: Mar. 25, 1999

Related U.S. Application Data

(60) Provisional application No. 60/106,140, filed on Oct. 29, 1998, and provisional application No. 60/117,525, filed on Jan. 28, 1999.

(51) Int. Cl.[7] ..... H01R 4/24

(52) U.S. Cl. ..... 439/418; 439/676

(58) Field of Search ..... 174/47, 95, 96, 174/97, 138 E, 113 C, 131 A, 135; 439/418, 676

(56) References Cited

U.S. PATENT DOCUMENTS 2,538,019 A * 1/1951 Lee ..... 174/113 C
4,614,028 A * 9/1986 Rich ..... 29/749
4,767,891 A * 8/1988 Biegon et al. ..... 174/131 A
5,772,465 A 6/1998 Hwang et al.
5,899,770 A * 5/1999 Ezawa ..... 439/418
5,969,295 A * 10/1999 Boucino et al. ..... 174/113 C
6,074,503 A * 6/2000 Clark et al. ..... 174/131 A
6,091,025 A * 7/2000 Cotter et al. ..... 174/110 R
6,099,345 A * 8/2000 Milner et al. ..... 439/460

FOREIGN PATENT DOCUMENTS

CA 2164398 A1 6/1996
CA 2186651 A1 3/1997

* cited by examiner

*Primary Examiner*—Dean A. Reichard
*Assistant Examiner*—Adolfo Nino
(74) *Attorney, Agent, or Firm*—Wolf, Greenfield & Sacks, P.C.

(57) ABSTRACT

A fixture is provided adjacent to a cable containing multiple twisted pairs. The fixture includes longitudinal channels for controlling the trajectory of the wire pairs after the twisted pairs have been exited the cable and have been detwisted. The fixture maintains the wire pairs in an orientation beneficial for reducing crosstalk.

31 Claims, 8 Drawing Sheets

FIXTURE FOR CONTROLLING THE TRAJECTORY OF WIRES TO REDUCE CROSSTALK

This appln claims benefit of Prov. Nos. 60/106,140 filed Oct. 29, 1998 and 60/117,525 filed Jan. 28, 1999.

BACKGROUND

1. Field of the Invention

The present invention relates to high-speed data communication cables. More particularly, it relates to a high-speed data communication cable that uses a mechanical fixture to stabilize and control the physical layout of twisted pairs in the detwisted segment of the cable jacket so as to reduce crosstalk between the wire pairs.

2. Related Art

High speed data communications cables in current usage include pairs of wire twisted together forming a balanced transmission line. Such pairs of wire are referred to as twisted pairs.

One common type of conventional cable for high-speed data communications includes multiple twisted pairs within it. In each twisted pair, the wires are twisted together in a helical fashion, thus forming a balanced transmission line. Twisted pairs that are placed in close proximity, such as within a cable, may transfer electrical energy from one pair of the cable to another. Such energy transfer between pairs is undesirable and is referred to as crosstalk. Crosstalk is electromagnetic noise coupled to a twisted pair from an adjacent twisted pair, or from an adjacent cable. Telecommunications systems contain noise that interferes with the transmission of information. Crosstalk increases the interference to the information being transmitted through the twisted pair. The increased interference due to crosstalk can cause an increase in the occurrence of data transmission errors and a concomitant decrease in the data transmission rate. The Telecommunications Industry Association (TIA) and Electronics Industry Association (EIA) have defined standards for crosstalk in a data communications cable that include: TIA/EIA 568-A-2, published Aug. 14, 1998. The International Electrotechnical Commission (IEC) has also defined standards for data communications cable crosstalk, including ISO/IEC 11801 that is the international equivalent to TIA/EIA 568-A. One high performance standard for data communications cable is ISO/IEC 11801, Category 5.

Crosstalk is primarily capacitively coupled or inductively coupled energy passing between adjacent twisted pairs within a cable. Among the factors that determine the amount of crosstalk energy coupled between the wires in adjacent twisted pairs, the center-to-center distance between the wires in the adjacent twisted pairs is very important. The center-to-center distance is defined herein to be the distance between the center of one wire of a twisted pair to the center of another wire in an adjacent twisted pair. The magnitude of both capacitively coupled and inductively coupled crosstalk is inversely proportional to the center-to-center distance between wires. Increasing the distance between twisted pairs can thus reduce the level of crosstalk interference. Another factor relating to the level of crosstalk is the distance over which the wires run parallel to one another. Twisted pairs that have longer parallel runs typically have higher levels of crosstalk occurring between them.

In twisted pairs, the rate of the twist is known as the twist lay, and it is the distance between adjacent twists of the wire. The direction of the twist of a twisted pair is known as the twist direction. Adjacent twisted pairs having the same twist lay and/or opposing twist directions tend to lie more closely together within a cable than if they have different twist lays and/or same twist directions. Thus, compared to twisted pairs having different twist lays and/or same twist directions, adjacent twisted pairs having the same twist lay and opposing directions have a reduced center-to-center distance, and longer parallel run. Therefore, the level of crosstalk energy coupled between the wires in adjacent twisted pairs tends to be higher between twisted pairs that have the same twist lay and/or opposing directions as compared to other twisted pairs that have different twist lays and/or same twist directions. Thus, the unique twist lay serves to decrease the level of crosstalk between the adjacent twisted pairs within the cable. Therefore, twisted pairs within a cable are sometimes given unique twist lays when compared to other adjacent twisted pairs within the cable.

As the continuous twisted or helical structure reaches a termination point, for example as the cable is terminated to be joined to a connector, the helical structures of the individual twisted pairs are deformed to mate with contacts in the terminating hardware creating a detwisted region within the cable. The actual angle of arrival of the helix of the individual twisted pairs in relation to the mating hardware depends on where the cable is cut within its length. Therefore, the amount of deformation required to align the conductors of the wire pair with the connection points can vary from twisted pair to twisted pair within a cable. The random nature of the deformation of the helical structure creates undesirable inter-pair coupling variations from one connector to the next. Therefore, although the unique twist lay and twist direction can reduce the level of crosstalk within the cable, the de-twisting action produces a level of crosstalk that tends to be random.

In an attempt to reach cross-manufacturer compatibility, EIA/TIA mandates a known coupling level in category 5 mating hardware. Mating hardware is designed, via counter-coupling, to compensate for the mandated coupling level in order to establish a predetermined level of coupling in a data communications link over a category 5 cable. The variability in the inter-pair coupling encountered from one plug to the next serves to limit the effectiveness of the counter-coupling compensation.

This specified, standard level of coupling within the mating hardware is provided so that overall the system can have a level of crosstalk that ensures that the particular transmission standard is properly met. Although it is possible to reduce the actual amount of coupling in the mating hardware to improve overall performance, this is not desirable in order to be in compliance with the appropriate standards and reverse compatibility reasons as well. What is preferable is a constant, repeatable and known level of crosstalk. If a category 5 plug is connected to a superior performance jack, it is expected that the plug and jack will be able to meet category 5 coupling specifications. This means that the jack/plug must be able to counter-couple for the level of coupling specified for a category 5 plug/jack. In addition, if two superior performance connectors are used, it is reasonable to expect that the superior performance mating hardware is able to counter-couple for the level of coupling specified for the superior performance hardware.

It is desirable for the crosstalk occurring in the region adjacent to where the twisted pairs have exited from the cable be of a known, consistent, repeatable, and standard value in order to mate with the connecting hardware. At least part of the region is herein referred to as the "detwisted" portion of the cable. Various conventional methods have been used in an attempt to improve the consistency of counter-coupling within the cable and jack or plug. For example, the use of shielded connectors, lead frames, and complex electronic counter-coupling have been used. However, these methods often increase the time required for installation, may require special tools, and can increase the material cost due to a larger parts count. This may lead to market acceptance problems due to the increased costs associated with the special tooling and the additional training required.

The EIA/TIA has mandated the values of the terminated open circuit crosstalk (TOC) which is assumed to represent the electrostatic component of the crosstalk. The TIA/EIA but has not yet mandated the values for terminated short circuit crosstalk(TSC) which is assumed to represent the magnetic component of crosstalk. Theory and models that support it predicts that the electrostatic coupling between wire pairs carries a phase offset of minus ninety (−90) degrees while magnetic coupling carries a phase offset of zero (0) or one hundred eighty (180) degrees. The models also depict that near end crosstalk and far end crosstalk are caused by the vectorial addition of these electrostatic and magnetic components, near end crosstalk having its current in reverse direction of far end crosstalk.

SUMMARY

A fixture is provided adjacent to a cable containing multiple twisted pairs. The fixture includes longitudinal channels for controlling the trajectory of the wire pairs after the twisted pairs have been exited the cable and have been de-twisted. The fixture maintains the wire pairs in an orientation beneficial for reducing crosstalk.

In one aspect of the present invention a fixture for use with a multi-wire cable having a plurality of twisted pairs of insulated conductors, the cable having a proximal exit region adjacent to a de-twisted region wherein said twisted pair of insulated conductor exit said cable and are transitioned to a de-twisted configuration consisting of wire pairs, at least a portion of the fixture can be axially adjacent to the de-twisted region of the cable the wire pair in the detwisted region of the multi-wire cable are disposed within corresponding of the plurality of channels such that the trajectories of the plurality of wire pairs are controlled.

In one embodiment the channels are disposed on the exterior surface of the fixture and can be disposed in a helical pattern. In another embodiment the fixture is generally cylindrical and the longitudinal channels are disposed on diametrically opposed sides of the fixture. In another embodiment, the longitudinal channels are W-shaped.

In another aspect of the present invention the fixture is generally planar and has longitudinal channels disposed on a top surface and bottom surface of the fixture. In one embodiment, the longitudinal channels are arranged so as to orient the wire pairs in proper arrangement for mating with mating hardware. In one embodiment, there can be two longitudinal channels on the top surface that each have one wire of a wire pair disposed therein and the three longitudinal channels on the bottom each configured to contain both the wires of a wire pair. The longitudinal channels are arranged so as to properly arrange the wire pairs for mating with the mating hardware.

BRIEF DESCRIPTION OF THE DRAWINGS

FIG. 1-A is an end view of the embodiment of FIG. 1;

DETAILED DESCRIPTION OF THE DRAWINGS

A fixture for controlling the trajectory of twisted pairs exiting a cable for connection to mating hardware for reducing crosstalk and controlling the characteristic impedance is disclosed. The fixture includes a body portion that has a distal end proximate to where the twisted pairs exit the cable and transition into a detwisted configuration of wire pairs. The fixture may include a plurality of longitudinal channels on the exterior surface of the body portion. In one embodiment, the number of longitudinal channels corresponds to the number of twisted pairs, and one twisted pair is disposed within each longitudinal channel. In another embodiment, the longitudinal channels are W-shaped having two sub-channels in each longitudinal channel. This allows each wire of the twisted pair to be disposed within an individual sub-channels.

Figure 1A:
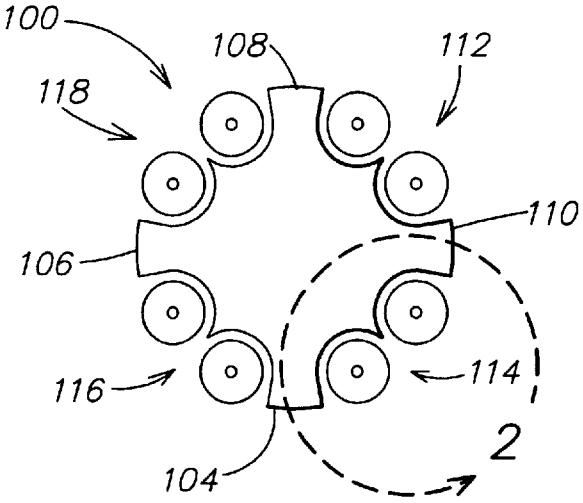
FIG. 1 is a side view of one embodiment of the present invention.
Figure 1:
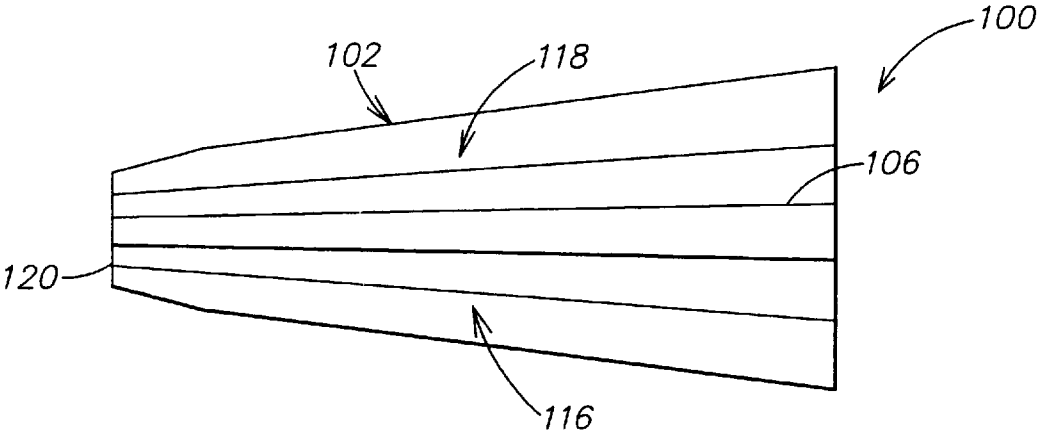
Figure 2:
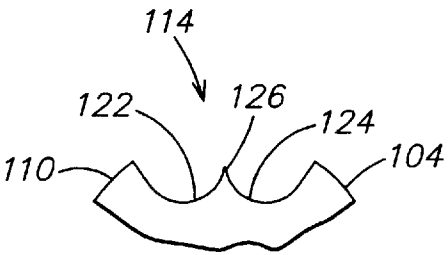
FIG. 2 is a view of an exemplary longitudinal channel of the embodiment of the invention shown in FIG. 1.

FIGS. 1, 1A and 2 illustrate one embodiment of the present invention in which a fixture 100 is disclosed. The fixture 100 includes a body portion 102 that has four longitudinal channel walls 104–110 disposed along its exterior surface forming 4 longitudinal channels 112–118 between them. In one embodiment, the body portion 102 is generally cylindrically shaped and tapers toward a distal end 120. In one embodiment, as shown in FIG. 2, the longitudinal channels can be formed in a W-shape having two adjacent sub-channels 122, 124 and a sub-channel divider 126. In this embodiment, one wire of the wire pair are disposed within each sub-channel 122, 124. In one embodiment, the longitudinal channels can be helically formed around the body portion (not shown) for maintaining the twist lay of the twisted pairs.

In one embodiment, the fixture 100 is inserted into a cable (not shown) containing four twisted pairs of wires, wherein the cable is cut and the twisted pairs exposed and a portion of the fixture 100 is inserted into the cable (not shown). Inserting a portion of the fixture into the cable axially aligns the distal end of the fixture with the cable. The twisted pairs are exited from the cable, detwisted, and placed in a longitudinal channel, with one wire of each pair disposed within a corresponding sub-channel.

In one embodiment, a head piece (not shown) is attached or coupled to the fixture 100 and is used to transition the twisted pairs of wires from the fixture into a configuration suitable for mating to a piece of mating hardware. The head piece can be constructed of the same material as the fixture 100. In addition, the head piece can provide additional isolation by a plurality of longitudinal channels guiding the various wires of the twisted pairs exiting the cable into the correct mating orientation. In this way the isolation of the various twisted pairs is maintained and a suitable level of crosstalk is maintained.

Figure 3:
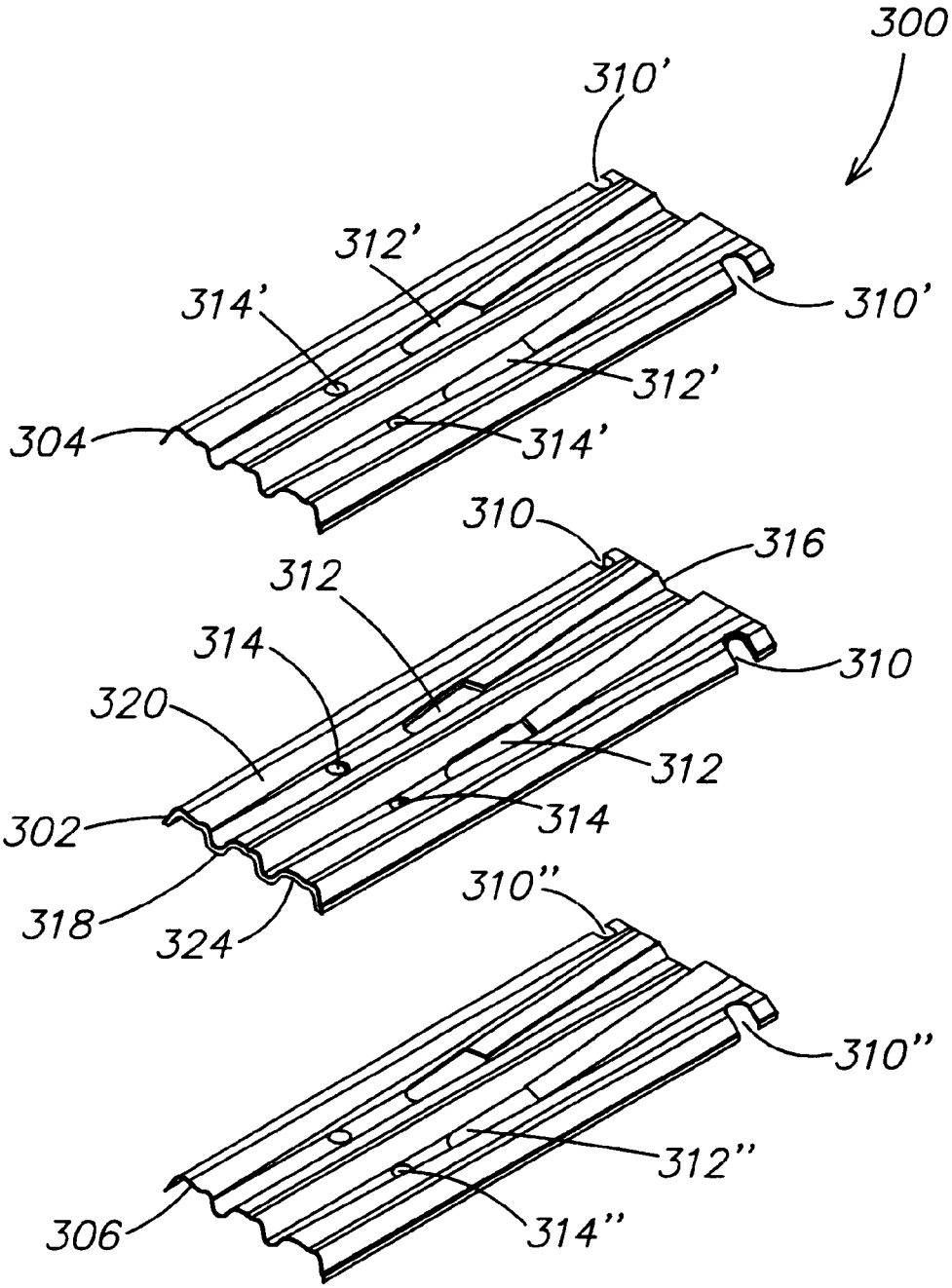
FIG. 3 is an exploded view of another embodiment of the present invention.
Figure 4:
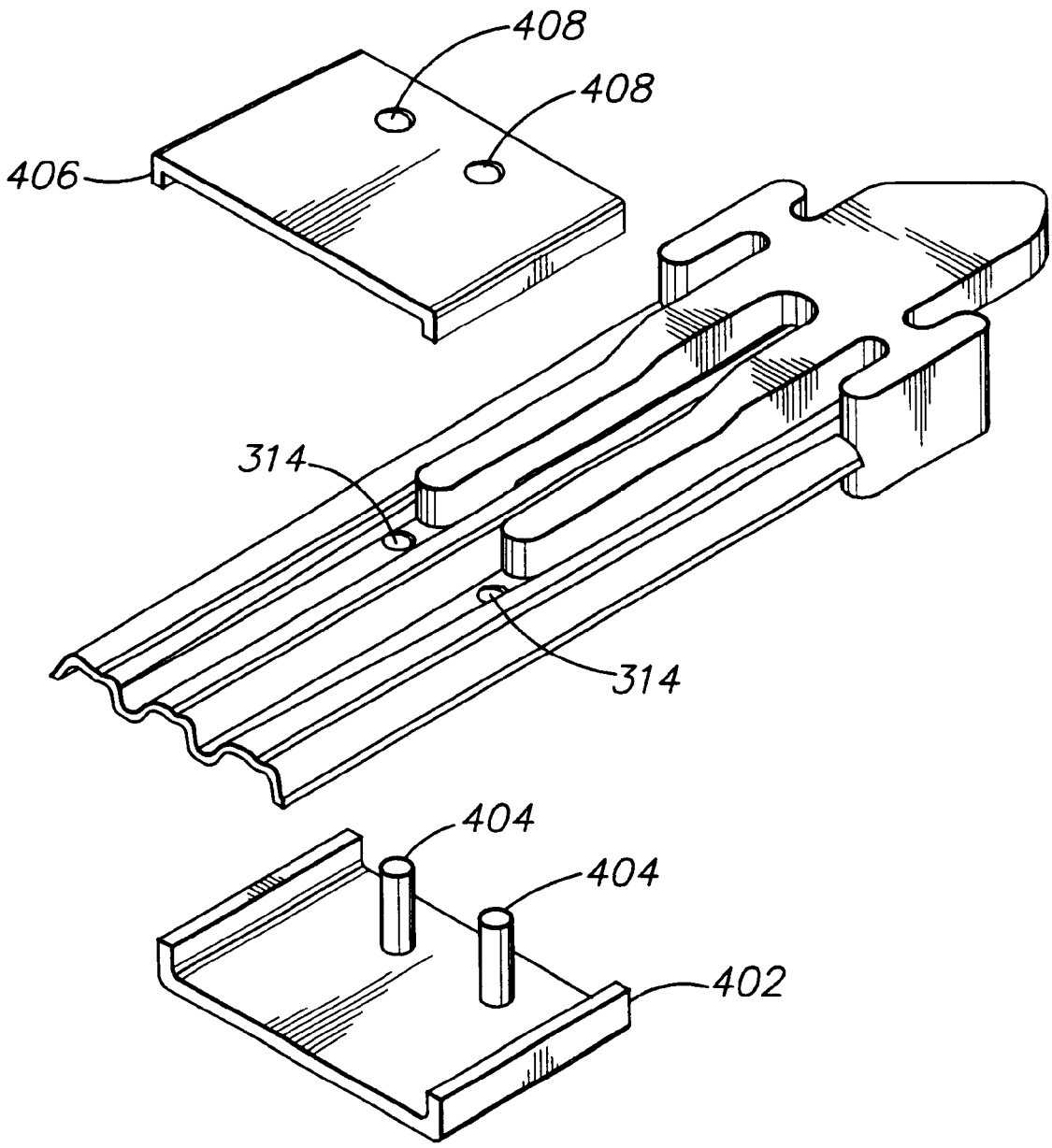
FIG. 4 is an exploded view of another embodiment of the present invention.
Figure 5:
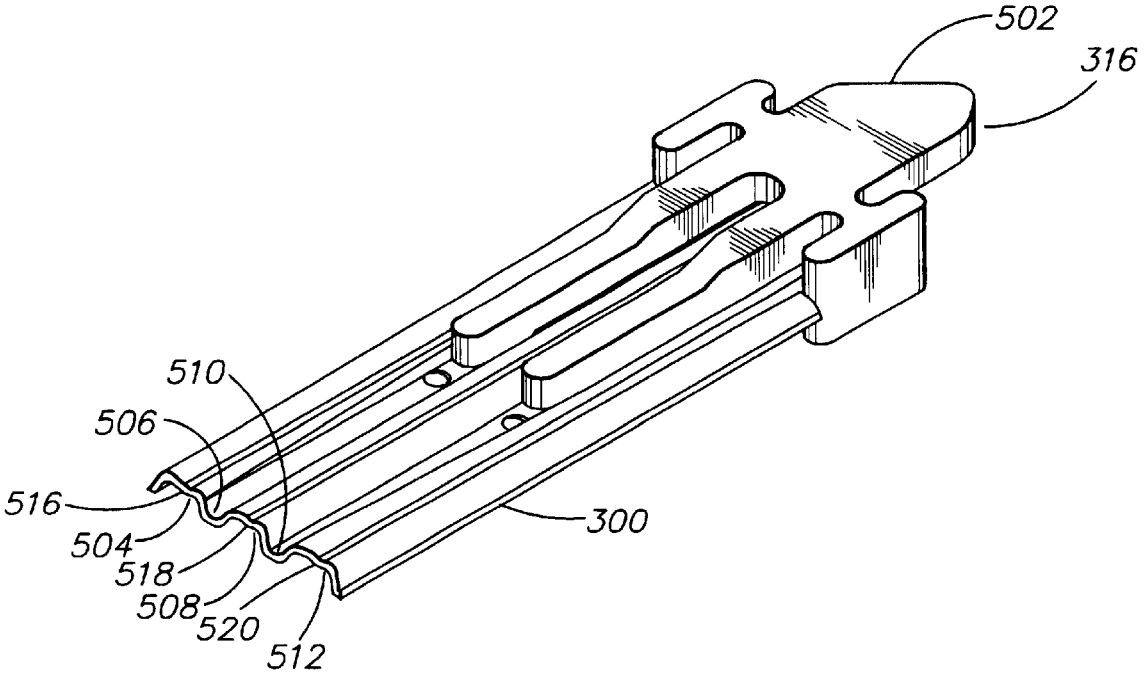
FIG. 5 is a perspective view of another embodiment of the present invention.

FIGS. 3–5 illustrate another embodiment of the present invention. The fixture 300 includes a generally planar fixture frame 302 covered by form fitting tape 304 and 306 on the top and bottom surfaces, 320 and 324 respectively, of fixture frame 302. The fixture frame 302 contain slots 310 near the distal end 316, and slots 312 located at approximately the middle of the longitudinal length, and holes 314 located at approximately one-third the longitudinal length from the proximate end 318. Tape 304 has slots 310', 312', and holes 314' defined therethrough and axially aligned with the slots 310, 312 and holes 314 defined within the fixture frame 302. Similarly, tape 306 contains slots 310", 312", and holes 314" defined therethrough and axially aligned with the slots 310, 312, and holes 314 defined within the fixture frame 302. Therefore, slots 310, 310' and 310" exist for a continuous passage defined through the laminated structure of tape 304, fixture frame 302, and tape 306. Similarly, slots 312, 312', and 312" and holes 314, 314', and 314" define continuous passageways through the laminated structure of tape 304, fixture frame 302, and tape 306.

The laminated structure of tape 304, fixture frame 302, and tape 306 include a plurality of longitudinal channels 504, 506, 508, 510, and 512. In the illustrative embodiment, channels 504, 508 and 512 are on the bottom surface 324 and channels 506 and 510 are on the top surface 320. In one embodiment, channels 506 and 510 are configured to hold one wire each of a wire pair and channels 504, 508, and 512 are configured to hold two wires separately. Channels 504, 508, 512 may, in an alternative embodiment include a center ridge 516, 518, and 520, respectively to separate the wires and more precisely control the trajectory of the wire pairs contained therein.

As shown in FIG. 5, in one embodiment a head piece 502 can be fitted to the laminated structure at the distal end 316 and secured through slots 310, 310', and 310" and 312, 312', and 312". The headpiece can be secured by ultrasonic welding, heat, glue or other method appropriate to an electrical system. In a preferred embodiment, the head piece is molded over the laminated structure. The head piece 502 is inserted into a cable (not shown), the twisted pairs are detwisted, and routed into particular channels. For instance, in the illustrative embodiment, pair 1 is placed in channel 508, pair 2 in channels 506 and 510, pair 3 is placed in channel 504 and pair 4 in channel 512. The placement of the pairs may be changed according to the requirements of those skilled in the art. The distal end 316 is inserted into a twisted pair cable (not shown), the twisted pairs are detwisted into wire pairs and the trajectory of the wire pairs is controlled by fixture 300.

In the embodiment shown in FIG. 4, a control bar 402, 406 is used to prevent movement of the fixture, control bar 402 has posts 404 that extend through the holes 314 and are received by holes 408. The control bars 402 and 406 are then secured by ultrasonic welding, heat, glue or other method appropriate to an electrical system. In a preferred embodiment, the control bar can be over molded onto the laminated structure. In an alternative embodiment, the fixture can be constructed without the control bar 402 and 406. The fixture can be manufactured from dielectric, conductive, or ferromagnetic materials or a combination of all three or a subcombination of any two of the materials. The fixture 100 can be sized and dimensioned in order to mate with the cable (not shown) and a head portion (not shown) that can guide the twisted pairs into the mating hardware (not shown).

In some embodiments, the fixture 100 or 300 can be constructed of a dielectric material. In these embodiments, the fixture 100 or 300, does not act as a shield preventing the coupling of electromagnetic fields from among the various twisted pairs of insulated conductors. Rather fixture 100 or 300, by virtue of having a given thickness and being disposed between two wires of two adjacent twisted pairs, increases the center-to-center distance between the adjacent twisted pairs and thus reduces the level of crosstalk between the twisted pairs. In addition, because fixture 100 or 300 may be a dielectric material, it can affect both the magnitude and phase of time-varying electromagnetic fields passing through it. Controlling the phase and magnitude of time-varying electromagnetic fields passing through the fixture 100 or 300 couples energy between twisted pairs within a cable to achieve a desired crosstalk level. Those skilled in the art may, using Maxwell's equations design such a fixture and many variations thereof guided by the principles of the invention discussed herein.

In other embodiments, the fixture 100 or 300 can be constructed of a conductive material. In addition to controlling the trajectory of the twisted pairs exiting the cable, the conductive material may further reduce crosstalk among the twisted pairs due to the shielding action of the conductor.

It is known in electromagnetic field theory that a conductor placed in the path of a time-varying electric, magnetic, or electromagnetic field will, ideally, prevent that time varying electromagnetic field from passing through the conductor, thus shielding the opposite side of the conductor from the time-varying field. There, of course, will be a small penetration of the conductor by the time-varying field. The depth of this penetration is known as penetration depth or skin depth and is inversely proportional to the conductivity of the material and the frequency of the time-varying field. While the penetration or skin depth depends upon the frequency, conductivity and thickness of the material, in general the more conductive the isolation element may be made, the better its shielding properties will be. For example, silver, copper, and aluminum foil, will provide superior shielding relative to the shielding provided by some less conductive materials.

However, the present invention is not limited to merely these materials. Other materials may be doped with conductive atoms or ions, in order to affect the magnitude and the phase of the energy passing through the isolation element. The fixture 100 or 300 can therefore be constructed of sheets of metallic foil, such as silver, copper or aluminum, or the isolation element can be constructed of plastic materials that have been ionized or doped with conducting atoms in order to increase their conductivity level while still retaining properties associated with a dielectric boundary.

In a twisted pair transmission line, the twisted pair form a balanced transmission line. A balanced transmission line can be driven differentially, that is each wire is driven with signals of equal and opposite amplitude. In contrast, a common mode signal is signal of equal amplitude on both wires. In most circumstances, noise within a transmission system will be a common mode signal when present in a twisted pair balanced transmission line. A differential apparatus coupled to a balanced transmission line will convey a differential signal while attenuating any common mode signals that are present according to the common mode rejection ratio of the apparatus. Therefore, it is important to maintain a high level of balance between the wires comprising a twisted pair.

Imbalance in a twisted pair can be caused by several factors. For example, placing a wire near a conductor forms a parasitic capacitor between the conductor and the wire. This parasitic capacitance affects the impedance of the wire and can also couple other interfering signals to the wire as well. In a twisted pair if there is a difference in the value of the parasitic capacitance for each of the wires in the twisted pair then the impedance will be unbalanced, and any noise signals, such as crosstalk, coupled to each wire can be unequal in magnitude. Thus, the twisted pair will no longer be a balanced transmission line, and some noise will converted to be a differential signal. This can lead to an decrease in the signal to noise ratio since the noise will not be rejected by the common mode rejection of the differential apparatus. Therefore under some circumstances, using conductive materials for the fixture 300 can lead to unbalancing of the twisted pairs and a degradation of performance.

One possible cause of the imbalance between the wires comprising the twisted pair can be any eccentricities in the location of the wire within the insulation surrounding it. During the manufacturing process of wires, conductors are often not placed perfectly within the center of the insulation surrounding them resulting in eccentricities within the wire. Because most wires are produced with a double twisting action, i.e., as the wires are twisted around each other, the individual wires are also back twisted so that the orientation of the wires with respect to each other is not constant, but rather varies with a given period. Over the length of the cable run, which is many times longer than the wavelengths of the transmitted signals, the changing orientation of the wires helps to ensure that on the average, the wires will be correct distance from each other. The same theory would be true for the fixture 300 if the fixture 300 was several twist lengths long. However, the fixture 300 generally extends for an electrically short length comparable to the wavelength of the transmitted signals, and any eccentricities present in the wires may result in the wires of each twisted pair being different distances from fixture 300. Thus, fixture 300 could cause an impedance imbalance to occur among the wires comprising the twisted pairs.

Figure 6:
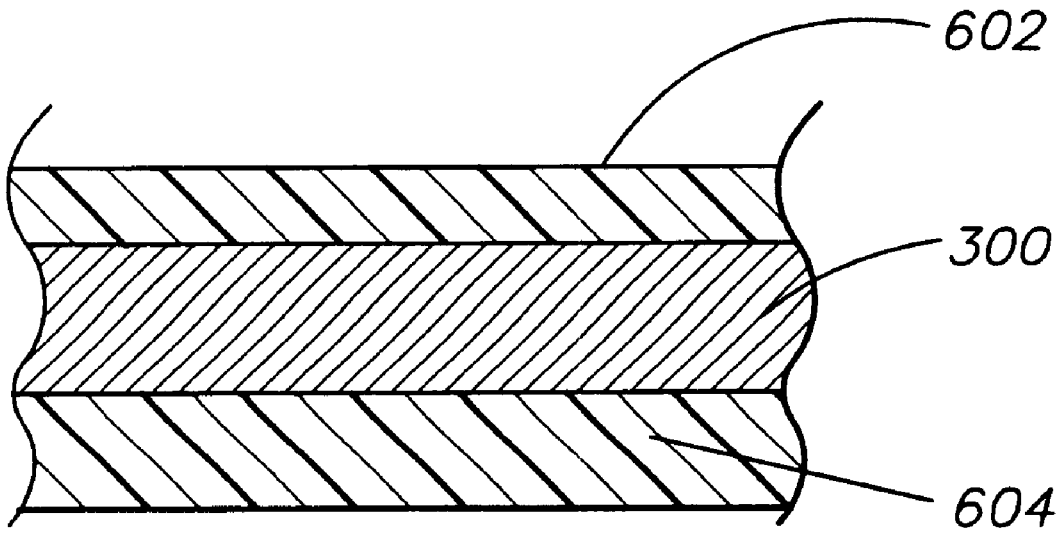
FIG. 6 is a cross sectional view of the structure of the fixture according to one embodiment of the present invention.

To reduce the effect of wire eccentricities, in one embodiment, fixture 300 can be covered with a dielectric material forming a laminated structure as shown in FIG. 6. The dielectric material, which in one embodiment is Mylar® tape, is used to increase the distance between fixture 300 and the wires of the twisted pairs. This increase in distance between the wires and the isolation element will be much larger than the eccentricities within the wire. The Mylar® tape therefore, will proportionally reduce the effect of any eccentricity of the position of the wire within the conductor. This will reduce any affect caused by the eccentricity of the wire and can increase the stability of fixture 300 with respect to the impedance of the twisted pairs. In one embodiment shown in FIG. 6, the dielectric layers, 602 and 604, covering fixture 300 do not have to be the same thickness. Furthermore, the tape may be used to adjust or alter the characteristic impedance of the pairs.

In another embodiment not shown, a pliable tubing having a plurality of longitudinal channels on the inside surface with each longitudinal channel having an adhesive on the inside surface could be placed over the detwisted pairs to control the trajectory of the pairs.

Figure 7:
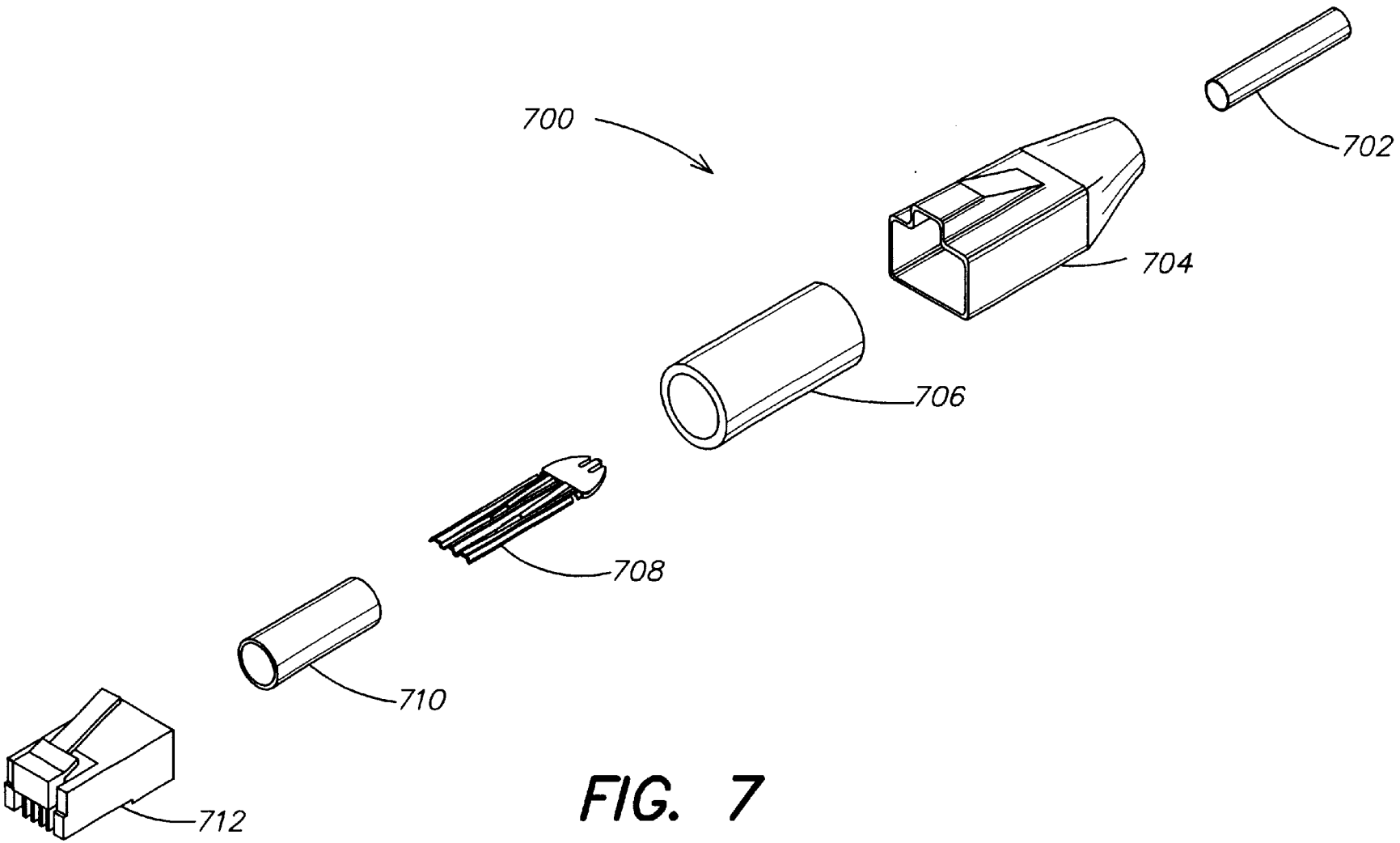
FIG. 7 is a perspective view of a presently preferred cable termination.

FIG. 7 illustrates a preferred embodiment of a cable termination 700 according to the present invention. The cable termination 700 includes the cable containing 4 twisted pairs 702, a cable boot 704 that is designed to house the cable termination hardware, a strain relief 706, an isolation element 708, shrink tubing 710 designed to be fitted over the isolation element 708 for physically securing the twisted pairs within their individual trajectories, and a modular plug 712. Preferably, the isolation element 708 is a laminated material consisting of 0.003 inch steel foil covered on both sides with Mylar®, polyester, foils, of 0.0025 inches and 0.0065 inches, respectively. The shrink tubing 710 is used to keep in place the twisted pairs once the wires have been properly placed and dressed on the isolation element 708. An adhesive liner on the shrink tubing advantageously prevents the dressed wires from migrating across the isolation element 708 during assembly. In another embodiment not shown, the wires may be crimped to provide the necessary mechanical stability. However, the process of crimping the wires may induce errors in the desired trajectories and introduce unwanted variations in the level of crosstalk and in the characteristic impedance. Thus, crimping the wires, while mechanically sound may degrade the performance of the fixture. Preferably, simple heating equipment will be needed to shrink the tubing. The cable boot 704 is provided with the plug for appearance and color identification. The strain relief 706 is used to provide effective strain relief between the cable jacket and the modular plug shell. This enables the connector to pass the mechanical pull test without having to crimp the wires together. Strain relief 706, in one embodiment, is used to provide increased mechanical stability for the isolation element 708 because the isolation element 708 may extend beyond the plug shell and not allow the jacket of the cable to be crimped by the plastic bar within the plug 712.

In one embodiment, the isolation element 708 can be adjusted by moving the metal foil forward toward the modular plug 712 or backwards toward the cable 702. This has the effect of increasing or decreasing the length of the parallel run of wires prior to mating with the modular plug 712. Thus, by moving isolation element 708 forward toward the plug, the parallel run length is decreased and thus, the crosstalk between adjacent wires is also decreased. By moving the isolation element 708 rearward toward the cable 702, the parallel run length of a adjacent wires is increased and thus the level of crosstalk is increased as well. Advantageously, this allows the terminated cable according to one embodiment of the invention to be adapted to changing crosstalk standards in the future. In one embodiment, the movement of isolation element 708 may be accomplished during production and in another embodiment, a field adjustable isolation element may be used.

Figure 8:
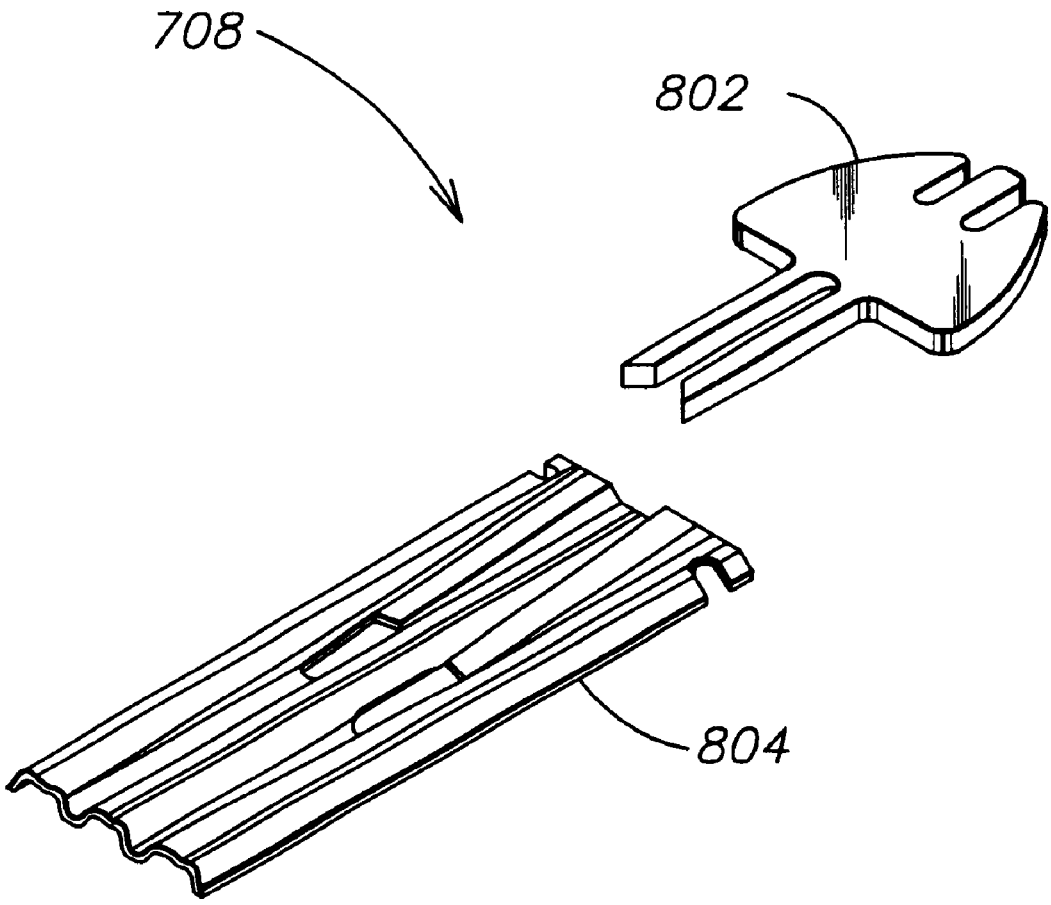
FIG. 8 is an exploded view of a management bar as shown in FIG. 7.
Figure 9:
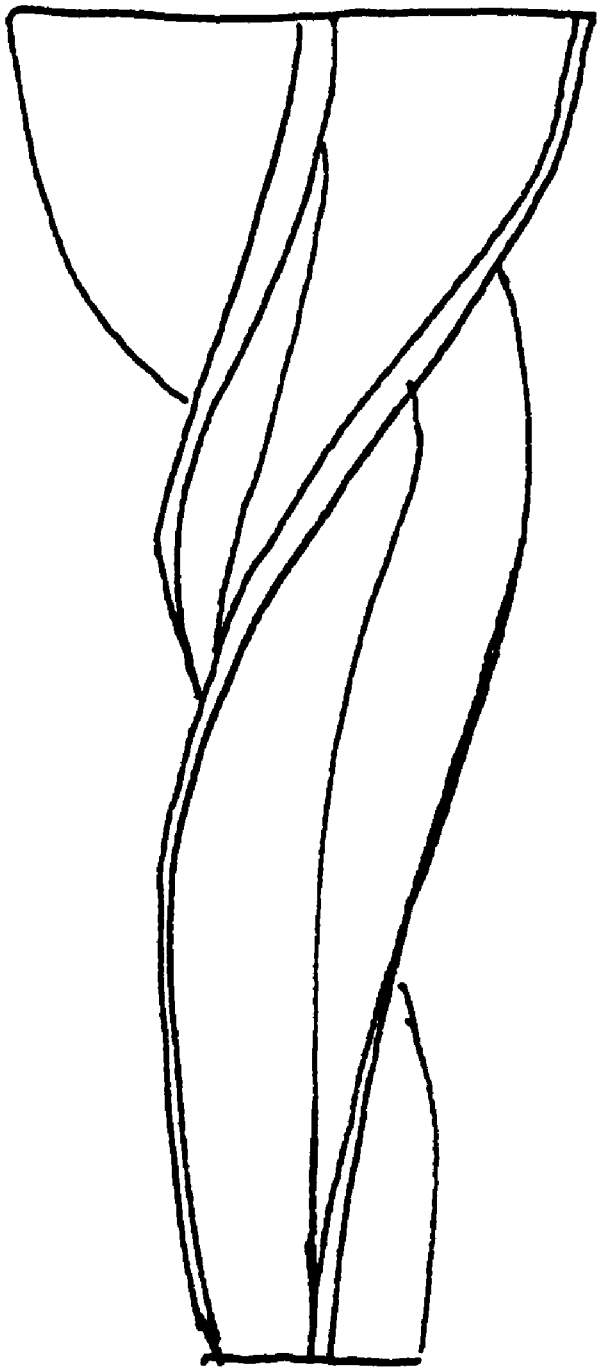
FIG. 9 is a side view of an alternate embodiment of the invention.

FIG. 8 illustrates a preferred embodiment of isolation element 708 that is comprised of a molded bar 802 and a formed foil management bar 804. The molded bar can be an injection molded plastic bar that is fitted onto 804 and extends into the 4 pair cable 1002 (not shown).

The present invention has now been described in connection with a number of specific embodiments thereof. However, numerous modifications which are contemplated as falling with in the scope of the present invention should now be apparent to those skilled in the art. Therefore, it is intended that the scope of the present invention be limited only by the scope of the claims appended hereto.

What is claimed is:

1. An apparatus for use with a multi-wire cable having a plurality of twisted pairs of insulated conductors, the cable having a proximal exit region adjacent to a detwisted region wherein said plurality of twisted pairs of insulated conductors exit said cable and are de-twisted into a plurality of pairs of singular conductors, the apparatus comprising:

a fixture having a distal region transversely adjacent and axially aligned with the multi-wire cable and inserted into the multi-wire cable;

said fixture controlling the trajectory of each singular conductor of said plurality of pairs of singular conductors through said de-twisted region.

2. The apparatus of claim 1 wherein the fixture includes a body portion that is substantially cylindrically shaped and tapers toward the distal region.

3. The apparatus of claim 1, wherein said fixture includes a plurality of longitudinal channels wherein said plurality of pairs of singular conductors are disposed within said plurality of longitudinal channels.

4. The apparatus of claim 3, wherein said fixture is generally cylindrical and said plurality of longitudinal channels are disposed in a helical pattern on an exterior surface of said fixture.

5. The apparatus of claim 3, wherein said plurality of longitudinal channels are arranged in pairs on said exterior surface of said fixture, wherein said channels arranged in pairs diametrically opposed to each other in a substantially X orientation.

6. The apparatus of claim 3, wherein said plurality of channels are arranged such that the pairs of singular insulated conductors are guided into a pre-determined arrangement and orientation for mating with a mating connector.

7. The apparatus of claim 3, wherein said channels are substantially U shaped.

8. The apparatus of claim 3, wherein said plurality of channels are W shaped for separating each of said pair of insulated conductors in said twisted wire pair from the other.

9. The apparatus of claim 3, wherein said plurality of channels further includes a pair of outside channel walls defining each channel of said plurality of channels.

10. The apparats of claim 9, wherein said outside channel walls are composed of a dielectric material.

11. The apparatus of claim 9, wherein said outside channel walls are composed of a conductive material.

12. The apparatus of claim 9, wherein said outside channel walls are composed of a ferromagnetic material.

13. The apparatus of claim 9, wherein said outside channel walls are composed of at least from the group consisting of a dielectric material, a conductive material, and a ferromagnetic material.

14. An apparatus for use with a multi-wire cable having a plurality of twisted pairs of insulated conductors, the cable having a proximal exit region adjacent to a detwisted region wherein said plurality of twisted pairs of insulated conductors exit said cable and are de-twisted into a plurality of pairs of singular conductors, the apparatus comprising:

a fixture having a distal region and a head region;

said fixture having at least a portion of said distal region transversely adjacent and axially aligned with the multi-wire cable and inserted into said proximal exit region of the multi-wire cable;

said fixture having a plurality of longitudinal channels extending from said distal region into said head region, wherein said plurality of pairs of singular conductors are disposed within corresponding longitudinal channels and wherein each singular conductor of said plurality of pairs of singular conductors in said de-twisted region are guided by said plurality of longitudinal channels such that the trajectories of each singular conductor of said plurality of pairs of singular conductors are controlled.

15. The apparatus of claim 14 wherein the fixture includes a body portion that is substantially cylindrically shaped and tapers toward the distal region.

16. The apparatus of claim 14, wherein said plurality of longitudinal channels are disposed on an exterior surface of said fixture.

17. The apparatus of claim 16, wherein, said fixture is generally planar having a top surface and a bottom surface;

said plurality of longitudinal channels includes a first plurality of longitudinal channels disposed on the top surface and a second plurality of longitudinal channels disposed on the bottom surface.

18. The apparatus of claim 17, wherein said plurality of channels are arranged such that the pairs of singular insulated conductors are guided into a pre-determined arrangement and orientation for mating with a mating connector.

19. The apparatus of claim 17, wherein the fixture comprises a laminated structure of materials.

20. The apparatus of claim 19, wherein the laminated structure includes a top material, a bottom material and an intermediate material.

21. The apparatus of claim 20, wherein the top material and bottom material are comprised of a dielectric material.

22. The apparatus of claim 21, wherein the dielectric material is Mylar®.

23. The apparatus of claim 21, wherein the top material has a first thickness and the bottom material has a second thickness.

24. The apparatus of claim 23, wherein the first and second thicknesses are substantially equal.

25. The apparatus of claim 23, wherein the first and second thicknesses are unequal.

26. The apparatus of claim 20, wherein the intermediate material is a conductor.

27. The apparatus of claim 26, wherein the conductor is stainless steel.

28. The apparatus of claim 14, further comprising a mating connector adjacent to said head region wherein said longitudinal channels orient said insulated conductors into a pre-determined arrangement for mating with said mating connector.

29. The apparatus of claim 14 wherein said plurality of longitudinal channels are U-shaped.

30. The apparatus of claim 14 wherein said plurality of longitudinal channels are W-shaped.

31. An apparatus for controlling a trajectory of each singular conductor of a plurality of pairs of singular conductors of a multi-wire cable through a de-twisted region where the conductors exit the cable, the apparatus comprising:

a fixture having a distal region transversely adjacent to and axially aligned with the cable and a head region;

the fixture having a plurality of longitudinal channels extending from the distal region to the head region, wherein each pair of the plurality of pairs of singular conductors is disposed within a corresponding longitudinal channel; and wherein the plurality of longitudinal channel are W-shaped, having two sub-channels within each longitudinal channel such that each singular conductor of the pair of singular conductors disposed within the longitudinal channel is disposed within a corresponding sub-channel, the sub-channel controlling the trajectory of the singular conductor through the detwisted region.

* * * * *

UNITED STATES PATENT AND TRADEMARK OFFICE

CERTIFICATE OF CORRECTION

PATENT NO. : 6,379,175 B1
DATED : April 30, 2002
INVENTOR(S) : Ivan Reede

It is certified that error appears in the above-identified patent and that said Letters Patent is hereby corrected as shown below:

Column 9,
Line 16, please replace “said” with -- an --.
Line 17, please insert -- and -- after “fixture.”
Line 18, please insert -- are -- after “pairs.”
Line 21, please insert -- longitudinal -- after “plurality of.”
Line 24, please insert -- longitudinal -- after “said.”
Line 27, please insert -- longitudinal -- before “channels.”
Line 27, please insert -- singular conductor -- after “each.”
Line 27, please replace “pair” with -- pairs --.
Line 28, please replace “insulated” with -- singular --.
Line 32, please replace “apparats” with -- apparatus. --
Line 39, please insert -- one material selected -- after “least.”

Column 10,
Line 11, please insert -- longitudinal -- after “plurality of.”
Line 12, please insert -- plurality of -- after “the.”
Line 37, please insert -- plurality of pairs of singular -- before “insulated.”

Signed and Sealed this

Twenty-ninth Day of October, 2002

*Attest:*

*Attesting Officer*

JAMES E. ROGAN
*Director of the United States Patent and Trademark Office*